United States Patent [19]

Van Heeswijk et al.

[11] Patent Number: 4,912,363

[45] Date of Patent: Mar. 27, 1990

[54] TUBULAR ELECTRIC INCANDESCENT LAMP

[75] Inventors: Johannes A. A. M. Van Heeswijk, Eindhoven, Netherlands; Reinhard Mayr, Gmunden, Austria

[73] Assignee: U.S. Philips Corporation, New York, N.Y.

[21] Appl. No.: 235,262

[22] Filed: Aug. 23, 1988

[30] Foreign Application Priority Data

Aug. 28, 1987 [NL] Netherlands ..... 8702013

[51] Int. Cl.[4] ..... H01K 7/00

[52] U.S. Cl. ..... 313/318; 313/315; 439/612; 439/280

[58] Field of Search ..... 313/318, 315; 362/217; 439/242, 612, 280, 226, 871, 830

[56] References Cited

U.S. PATENT DOCUMENTS 2,145,787 1/1939 Reamer ..... 362/217 X 4,751,422 6/1988 Morianz et al. ..... 313/318

*Primary Examiner*—Kenneth Wieder

*Attorney, Agent, or Firm*—Brian J. Wieghaus

[57] ABSTRACT

The tubular electric incandescent lamp has at its ends metal hoods, to which current supply conductors are secured. The metal hoods are accommodated in an insulator housing provided with an opening, through which a contact member extends to the exterior. The contact member is a metal strap with resilient tongues, which engage a metal hood behind a collar. The insulator housing has a tapering slot with a widened part, in which free end portions of the metal strap are enclosed. The unit of contact member and housing thus obtained is undetachably connected to the lamp in that it is axially slipped around the metal hood.

5 Claims, 1 Drawing Sheet

TUBULAR ELECTRIC INCANDESCENT LAMP

BACKGROUND OF THE INVENTION

The invention relates to a tubular electric incandescent lamp provided with: a tubular translucent lamp vessel sealed in a vacuumtight manner and having a longitudinal axis, a filament longitudinally arranged in the lamp vessel, a respective metal hood accommodated in a respective cupshaped insulator housing and secured to the ends of the lamp vessel, current supply conductors extending from the filament to a respective metal hood, contact members or lamp bases connected to a respective metal hood and extending through an opening in the respective insulator housing transversely of the longitudinal axis of the lamp vessel to the exterior.

Such a lamp is known from U.S. Pat. No. 2,145,787. The known lamp has disk-shaped metal hoods fused with the tubular lamp vessel. The metal hoods have a recess in their central parts. The lamp bases or contact members, are each undetachably connected to an insulator housing. At a part located inside the insulator housing they have resilient fingers, which are arranged so that they can engage together the recess of the metal hood. The contact members can then be rotated through an arbitrary angle about the axis of the lamp vessel. A lamp provided on either side with such a contact member is ready to be placed with these contact members in the lamp holders of a luminaire intended thereto.

The known lamp has the disadvantage that, when the lamp is removed from the luminaire, the connection between a contact member and the lamp vessel can be lost, while the connection between the luminaire, and this contact member is maintained. When attempts are then made to remove this contact member from the luminaire, there is a risk of the resilient fingers being touched while they are still live.

Since both contact members have to get into contact with a respective lamp holder of a luminaire, the relative distance of these lamp holders should be adapted to the relative distance of the contact members. However, it has been found that the relative distance of the lamp holders can differ so strongly from the relative distance of the contact members of the lamp that the contact members must be placed in an oblique position with respect to the axis of the lamp vessel in order to be able to arrange these contact members in the lamp holders. There is then a risk of the resilient fingers of the contact members losing their grip on the recess in the metal hood. There is moreover a risk that a metal hood of the lamp can be touched whilst the lamp is in the luminaire and is live.

U.S. Pat. No. 4,751,422, an incandescent lamp of the kind mentioned in the opening paragraph is described, in which

- the metal hoods are hollow bodies having a continuous wall and a bottom portion, which abut with their open ends against the lamp vessel and have a collar near their bottom portions,
- the contact members each have a prong engaging with clamping fit the continuous wall of the respective metal hood on the side of the collar remote from the bottom portion, and
- the insulator housings lock the relevant contact members against radial displacement.

In practical embodiments, the insulator housings of the incandescent lamp according to the said Patent Application comprise a tubular part and a cup-shaped part. The cup-shaped part has a bottom portion and a continuous wall portion. The latter portion may be located with its end remote from the bottom portion within the tubular part. The parts can be undetachably interconnected in different ways, for example by means of glue or ultrasonic vibrations or in a mechanical manner, for example by a snap connection by means of barbed hooks.

In these embodiments, a comparatively large number of parts have to be joined in the last step of manufacturing the incandescent lamp. Thus, the manufacture of the lamp is delayed and also the cost price of the lamp is influenced.

SUMMARY OF THE INVENTION

The invention has for its object to provide a lamp of the kind mentioned in the opening paragraph, whose contact members, or lamp bases can be joined with the lamp very readily and with a small number of parts and are then undetachably connected to the metal hoods. The invention more particularly has for its object to provide such a lamp having a construction which permits of using the lamp in the luminaires having different relative distances of the lamp holders without a different position of the contact members then being required.

According to the invention, this object is achieved in a lamp of the kind described in the opening paragraph in that the metal hoods are hollow bodies having a continuous wall, and a bottom portion which abut with their open ends against the lamp vessel and have a collor or shoulder near their bottom portions, the lamp bases, each are a metal strap surrounding a respective metal hood with clamping fit, this metal strap being provided with: resilient tongues having a free end directed inwards and towards the bottom portion of the metal hood, these tongues engaging the metal hood on the side of the collar remote from the bottom portion, and free end portions extending transversely from a said insulator housing to the exterior, the cup-shaped insulator housings each have an axial slot merging into their edge, tapering from this edge and having a widened part at its end remote from said edge, the free end portions of the relevant contact member being axially enclosed in the widened part in said slot.

The lamp according to the invention affords the advantage that during the manufacture of the lamp a unit of an insulator housing and a lamp bases always can be supplied as a lamp part. The insulator housing can be made in one piece. The contact member, or lamp base, can be axially slipped into it. The free end portions are then forced by the tapering slot in the insulator housing more and more closely to each other until they have reached the widened part in this slot and move away from each other by spring force. The contact member is then coupled to the insulator housing.

During the manufacture of the lamp, the unit of insulator housing and contact member can be axially slipped over a metal hood until the resilient tongues have passed the collar, or shoulder, of the metal hood and engage behind this shoulder. An undetachable unit is then obtained. The insulator housing cannot be removed because the contact member is coupled to it; the contact member cannot be removed because the resilient tongues hook behind the collar.

The insulator housing can support by its dimensioning the clamping force of the contact member on the metal hood. The insulator housing with the contact member can be axially displaceable between a first position in which the resilient tongues engage the collar and a second position in which the insulator housing abuts against the lamp: against the lamp and/or against the metal hood.

In order to promote a good electrical contact with the metal hood, it is favourable when the contact member has a few, for example, three, axially extending inwardly projecting ribs distributed along the circumference of the hood.

On behalf of the safety of touching the lamp, the length of the insulator housings is preferably chosen so that they surround the metal hoods laterally at least substantially entirely even if the insulator housings are displaceable.

The continuous wall of the metal hood may be circular-cylindrical, but may alternatively have other cylindrical shapes.

BRIEF DESCRIPTION OF THE DRAWINGS

Embodiments of the lamp according to the invention will be described more fully with reference to the drawing.

DESCRIPTION OF THE PREFERRED EMBODIMENT

Figure 1:
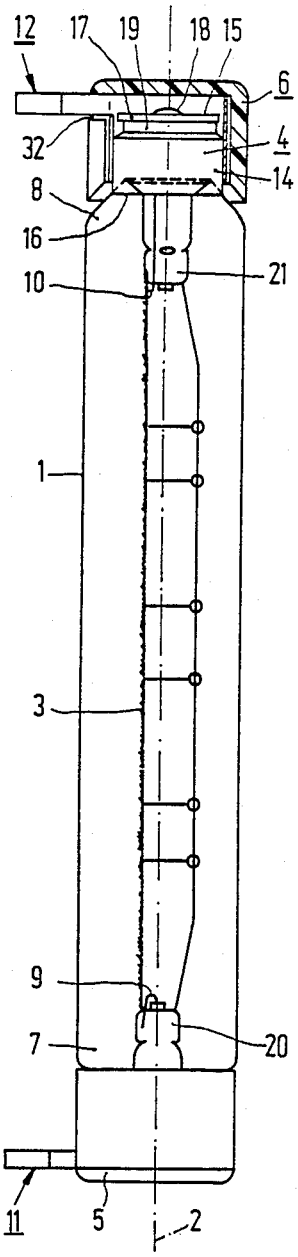
FIG. 1 is a side elevation of a lamp with an insulator housing and a contact member in an axial sectional view.

In FIG. 1, the lamp has a tubular translucent lamp vessel 1 sealed in a vacuum-tight manner and having a longitudinal axis 2, a filament 3 being longitudinially arranged in this lamp vessel 1. A respective metal hood 4 accommodated in a respective cup-shaped insulator housing 5,6 of synthetic material is secured to the ends 7, 8 of the lamp vessel 1. Current supply conductors 9, 10 extend from the filament 3 to a respective metal hood 4. Contact members 11, 12 connected to a respective metal hood 4 extend though an opening 32 in the relevant insulator housing 5, 6 transversely of the longitudinal axis 2 of the lamp vessel 1 to the exterior.

The metal hoods 4 are hollow bodies with a continuous wall 14 and a bottom portion 15, which abut with their open ends 16 against the lamp vessel 1 and have a collar 17 near their bottom portions 15. The current supply conductors 9, 10 are secured by means of solder 18 to the bottom portion 15 of a respective metal hood 4.

Due to the fact that the metal hood 4 is wide at its open end 16 and has a collar, or shoulder 17, its continuous wall 14 has a groove 19.

In contrast with the known lamp according to U.S. Pat. No. 2,145,787, the lamp vessel 1 is not closed by the metal hoods 4. At its ends 7,8 the lamp vessel 1 is fused with the stem tubes 20,21 closing the lamp vessel 1. The metal hoods 4 are secured by means of cement on the ends 7,8. Also due to this fact, the lamp can be manufactured in a very simple manner.

Reference may simultaneously be made to FIGS. 1 to 4. The contact member 12, like the contact member 11, is a metal strap 22 surrounding the relevant metal hood 4 with clamping fit. The metal strap 22 is provided with resilient tongues 23 having a free end 24 directed inwards and towards the bottom portion 15 of the metal hood 4. The tongues 23 engage the metal hood 4 on the side of the collar 17 remote from the bottom portion 15.

The metal strap 22 is further provided with free end portions 25, which extend transversely out of an insulator housing 6.

The cup-shaped insulator housings 5,6 each have an axial slot 30, which merges into the edge 31 of the housing 5,6, tapers from this edge (FIG. 4) and has at its end remote from this edge 31 a widened part 32, in which the free end portions 25 of the contact member 12 are axially enclosed.

Figure 2:
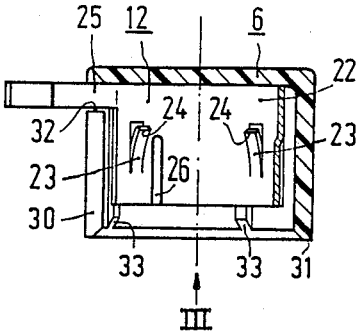
FIG. 2 shows on an enlarged scale in axial sectional view an insulator housing with a contact member.
Figure 3:
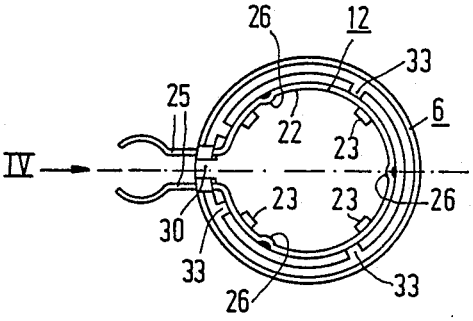
FIG. 3 is a front elevation of an insulator housing with a contact member.
Figure 4:
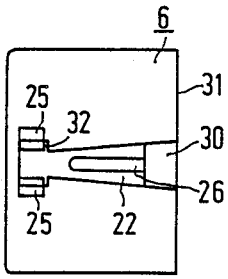
FIG. 4 is a side elevation of an insulator housing with a contact member.

FIGS. 2 to 4 show a unit of an insulator housing 6 and a contact member 12 obtained by slipping the contact member 12 axially into the insulator housing 6, the free end portions 25 then following the slot 30 and being forced more and more closely to each other until they have reached the widened part 32 in the slot 30. The free end portions 25 are then moved away from each other by spring force and a coupling is established. In the embodiment shown, substantially no displacement of the contact member 12 in the housing 6 is possible any longer.

The unit 6,12 shown is then axially slipped into the metal hood 4 until the free ends 24 of the resilient tongues 23 engage behind the collar 17. The unit 6,12 is then undetachably coupled to the metal hood 4 and hence to the lamp.

The insulator housing 6 can be rotated with the contact member 12 about the metal hood 4 and can be displaced along this metal hood from a first position in which the free ends 24 of the tongues 23 engage the collar 17 to a second position in which the insulator housing 6 abuts against the lamp: against the lamp vessel 1 and/or against the metal hood 4. As a result, the lamp can be adapted to the lamp holder distance of an individual luminaire.

Nevertheless the insulator housings 5,6 at least substantially entirely surround the relevant metal hood 4.

In FIGS. 2 to 4, axially extending inwardly directed ribs 26 are visible at the contact member 12, which are distributed along the circumference of the metal hood 4.

The housing 6 of synthetic material has ribs 33, which engage the strap 21 and thus support the clamping force of the contact member 12 on the metal hood 4.

What is claimed is:

1. A tubular electric incandescent lamp, comprising:

an elongate tubular translucent lamp vessel having ends sealed in a gas-tight manner;

a filament longitudinally arranged in said lamp vessel;

a pair of metallic hoods each having continuous tubular side walls, an open end fixed to a respective sealed end of said vessel and an opposite closed end, and a circumferential shoulder adjacnet said closed end;

a pair of current-supply conductors each extending from said filament, through a sealed end of said vessel, and connected to a respective metallic hood; and a pair of lamp bases each secured on a respective metallic hood, each lamp base comprising a one-piece cup-shaped insulative housing having a tubular sidewall defining a housing axis, an open end defining a circumferential edge of said sidewall and an opposite closed end, said sidewall having a slot with an axial portion extending from said circumferential edge with tapered edges tapering toward said closed end, and a widened transverse portion at the end of said slot remote from said circumferential edge having transverse edges joining said tapered edges, and a resilient metallic contact strap secured in said housing, said strap having a major center portion and a pair of end portions extending oppositely from said major portion, said major portion extending circumferentially around the inside of said tubular sidewall of said housing and terminating adjacent said slot, said end portions extending from said major portion opposite to each other out through said transverse portion of said housing slot and forming electrical contacts of said lamp base, said major portion extending axially over a major part of said housing sidewall and having a plurality of resilient tongues having a free ends directed inward and towards the closed end of said housing, each contact strap being insertable in said housing with said opposing contact portions passing axially through said slot to said transverse portion, said contact portions springing into said transverse portion and engaging said transverse edge of said slot for securing said strap in said housing with said major portion contacting said housing sidewalls, said lamp bases being securable on a respective metallic hood with said resilient tongues snapping passed said hood shoulder as the circumferential edge of said housing is urged towards said sealed vessel end, said major portion of said contact being disposed against said housing side-walls for engaging said hood sidewalls with a clamping fit, and said ends of said resilient tongues being arranged for engaging said shoulder for locking each lamp base on a respective hood.

2. A tubular electric incandescent lamp as claimed in claim 1, wherein said tongue ends are spaced from said circumferential edge of said housing on a said lamp base such that the lamp base is longitudinally displaceable on the respective metallic hood.

3. A tubular incandescent lamp as claimed in claim 2, wherein the insulator housings surround at least substantially entirely the respective metal hood.

4. A tubular incandescent lamp as claimed in claim 1, wherein said metallic strap has a plurality of axially extending inwardly directed ribs distributed along the inner circumference of said major portion.

5. A tubular incandescent lamp as claimed in claim 1, wherein the insulator housings surround at least substantially entirely the respective metal hood.

* * * * *